US007730844B2

(12) United States Patent
Ayoub

(10) Patent No.: US 7,730,844 B2
(45) Date of Patent: Jun. 8, 2010

(54) BUMPER SYSTEM

(76) Inventor: Ihab Ayoub, 221 W. Dallas St., #1632, Houston, TX (US) 77019

( * ) Notice: Subject to any disclaimer, the term of this patent is extended or adjusted under 35 U.S.C. 154(b) by 0 days.

(21) Appl. No.: 11/277,031

(22) Filed: Mar. 20, 2006

(65) Prior Publication Data

US 2006/0207486 A1 Sep. 21, 2006

Related U.S. Application Data

(60) Provisional application No. 60/594,208, filed on Mar. 18, 2005.

(51) Int. Cl.
*B63B 59/02* (2006.01)

(52) U.S. Cl. ..... 114/219

(58) Field of Classification Search ..... 114/219; 405/212–215

See application file for complete search history.

(56) References Cited

U.S. PATENT DOCUMENTS 3,055,335 A * 9/1962 Gordon et al. ..... 114/219
3,077,175 A * 2/1963 Johnson ..... 114/219
3,084,517 A * 4/1963 Bell ..... 405/213
3,109,404 A * 11/1963 Hartel ..... 114/219
3,145,685 A * 8/1964 Kulick, Sr. ..... 114/220
3,688,728 A * 9/1972 Lederer, Jr. ..... 114/219
4,565,147 A * 1/1986 Bortolotti ..... 114/219
4,875,427 A * 10/1989 Harris, Jr. ..... 114/219
4,964,760 A * 10/1990 Hartman ..... 405/215
5,036,784 A * 8/1991 Wagner ..... 114/219

FOREIGN PATENT DOCUMENTS

JP 2001-63685 * 3/2001

OTHER PUBLICATIONS

Translation of Japan 2001-063685.*

* cited by examiner

*Primary Examiner*—Stephen Avila

(57) ABSTRACT

Variations of a bumper systems are disclosed. A bumper system may have one or more rotatable members and/or non-rotatable members configured to protect a vessel or structure during docking maneuvers and mooring. The rotatable and non-rotatable members may be located at any one or more desired locations on the vessel and/or its mooring. In use, rotatable members are rotated from a first rotational position to a second rotational position. Various components of the bumper system may be configured to provide protection due to their compressibility, tiltability, flexibility and/or moveability. The connection between a rotatable member and its substrate may serve as an axis of rotation of the rotatable member, may be configured to include one or more mechanisms for rotating the rotatable member and may also include mechanisms for absorbing and/or dissipating the energy transmitted during physical interactions between vessels, and/or structures. The rotatable and non-rotatable members may be configured to extend from a surface to which they are connected, and the bumper system may also be configured such that a boundary is formed between one or more rotatable members, non-rotatable members, and the substrate to which they are connected. Methods for manufacturing and using bumper systems according to the described configurations are also disclosed.

16 Claims, 15 Drawing Sheets

BUMPER SYSTEM

CROSS-REFERENCE TO RELATED APPLICATIONS

This application claims priority to U.S. Provisional Patent Application No. 60/594,208, filed Mar. 18, 2005, and entitled "BUMPER SYSTEM," hereby incorporated by reference.

BACKGROUND OF INVENTION

1. Field of the Invention

The invention relates generally to bumper systems for lessening and/or preventing damage due to impact between two or more objects.

2. Background Art

Boats and other marine vessels and structures are subject to damage when moored. Wind and waves have the tendency of moving a floating vessel with respect to its mooring, whether the mooring is stationary or floating. Relative movement of a vessel with respect to its mooring often causes the vessel to hit and/or slide against the mooring, possibly damaging the vessel and/or its mooring. Although the risk of damage to a moored vessel is increased when the mooring is in a fixed position, mooring to a floating structure or a second vessel may also result in damage due to relative movement, as the vessel and its mooring will likely not be in perfect synchronicity of movement.

As shown in FIG. 1A, in order to lessen the occurrence and magnitude of damage due to contact between a vessel and its mooring, most marine vessels include a relatively tough elastomeric rubrail 2, usually extending along the circumference of the vessel hull, typically at its widest point. The rubrail 2 extends outwardly from the hull 4 such that it will contact an object, such as a mooring, before such an object contacts and damages the hull 4. The rubrail 2 will typically have an energy-absorbing configuration, often including elastomeric materials, foam, and combinations thereof.

Moorings often include a similar configuration along their periphery (shown at 5 in FIG. 1C) and the pilings (7 in FIG. 1C) of fixed moorings are often padded along some vertical portion of their height to provide some modicum of protection. The materials used with such approaches are typically thin so that they do not greatly extend from the hull 4 and/or mooring and are often relatively tough due to a desire for durability, particularly on moorings. Protective devices on a mooring are usually placed at set locations predicted to make contact with particular configurations of vessels and may not be suitably located for other types of vessels. Furthermore, certain problematic interactions between vessel and mooring, such as the possibility of some portion of the vessel dropping below and then catching on the bottom edge of the mooring, are not sufficiently resolved by such approaches, and in some cases may be exacerbated. Vertical displacement of a vessel is quite common due to waves, rising and falling tides, and shifting or varying loads.

As shown in FIGS. 1B-1C, another approach to lessening the likelihood and extent of damage caused by relative movement of a vessel with respect to its mooring is to hang individual fenders 3 along the sides of the vessel. A fender 3 protects a vessel and/or its mooring by cushioning an impact between the two. Such fenders 3 will typically be suspended along the sides of a vessel and/or mooring by an operator. Because the fenders 3 are typically connected by one end and therefore able to move with relative freedom, a suboptimal alignment or positioning may result, lessening their ability to protect a moored vessel from impact with its mooring. Furthermore, placement of a fender 3 under particular conditions may result in a significant decrease in fender 3 effectiveness when those conditions change such as may occur due to wave or tidal action, or a shifting or varying load, as shown in FIG. 1D.

As shown in FIGS. 1E-1F, the configuration and deployment of traditional fenders 3 typically will render them relatively ineffective in protecting certain portions of a vessel, which may be damaged due to wave or tidal action lowering the vessel with respect to its mooring such that an edge of the vessel may orient under a portion of its mooring, resulting in damage as the vessel rises with respect to the mooring. Certain fenders have been configured to partly address this problem, by extending up the side of a vessel and along a portion of the top of the outer edge of the vessel. Such fenders are typically more bulky than standard fenders and still susceptible to displacement from a desired alignment, lessening their effectiveness.

Furthermore, traditional deployable fenders 3 require storage, typically within the relatively limited confines of the vessel. Such fenders 3 will also require that one or more operators manually deploy and secure each fender 3, based upon a prediction of possible interactions between vessel and mooring. This difficulty is compounded when the individual deploying the fenders 3 is also responsible for operating the vessel during docking maneuvers. Due to operator error, and the difficulty of estimating all possible interactions between vessel and mooring, the deployment of traditional fenders 3 may not result in an optimal protection of the vessel and/or mooring. In addition, such fenders 3 are prone to being lost overboard when being deployed or removed.

Accordingly, it is desirable to have an efficient protective apparatus that is easily used and effective in protecting a vessel and/or mooring from damage due to relative movement and/or other interactions. It is further desirable to have such an apparatus that may be easily and/or remotely deployed and properly positioned.

SUMMARY OF INVENTION

In one embodiment, the invention comprises a bumper system having rotatable and/or extendable members. Retaining elements may be used to maintain one or more members in at least one predetermined configuration. The bumper system and its components may be configured to be flexible, tiltable, and/or shock absorbing. The bumper system may also include one or more components for forming a boundary between one or more members thereof, and a substrate to which the member(s) is/are operatively connected.

In one embodiment, the invention comprises a method of manufacturing a bumper system. One or more members are rotatably and/or extendably connected to a substrate. Retaining elements may be disposed on the members and/or substrate to which the members are operatively connected.

Other aspects and advantages of the invention will be apparent from the following description and the appended claims.

DETAILED DESCRIPTION

Figure 1A:
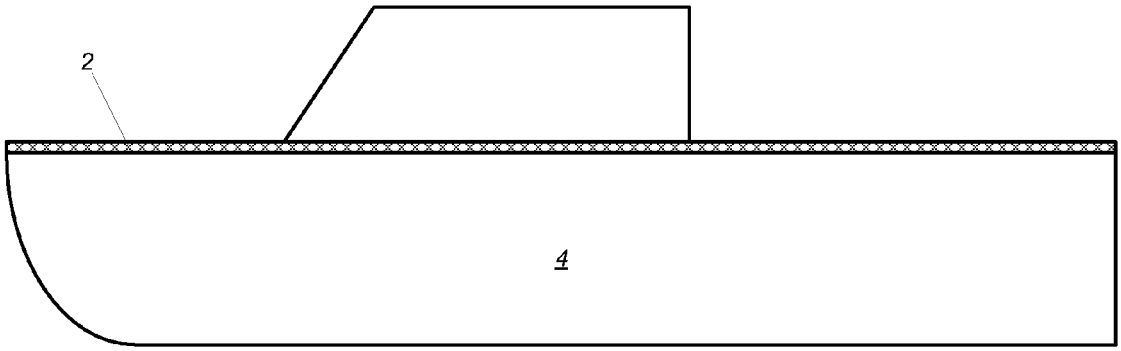
Fig. 1A (prior art)
FIG. 1A shows a prior art vessel having a traditional rubrail.
Figure 1B:
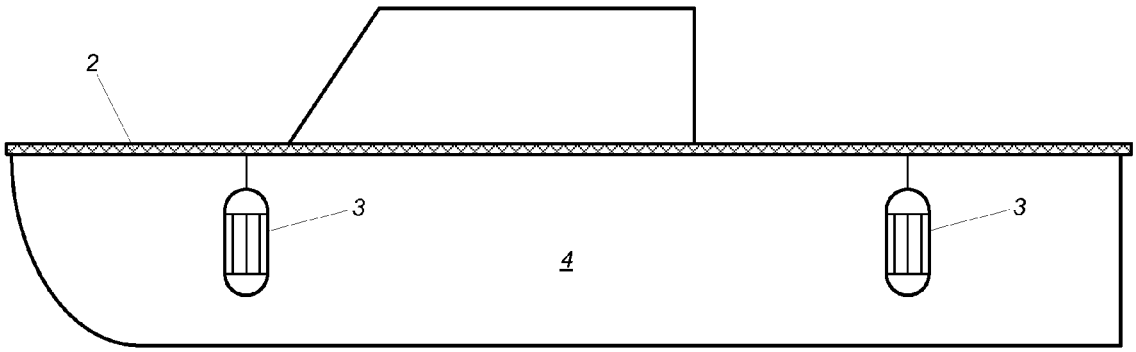
Fig. 1B (prior art)
FIG. 1B shows prior art fenders in a traditional deployment.
Figure 1C:
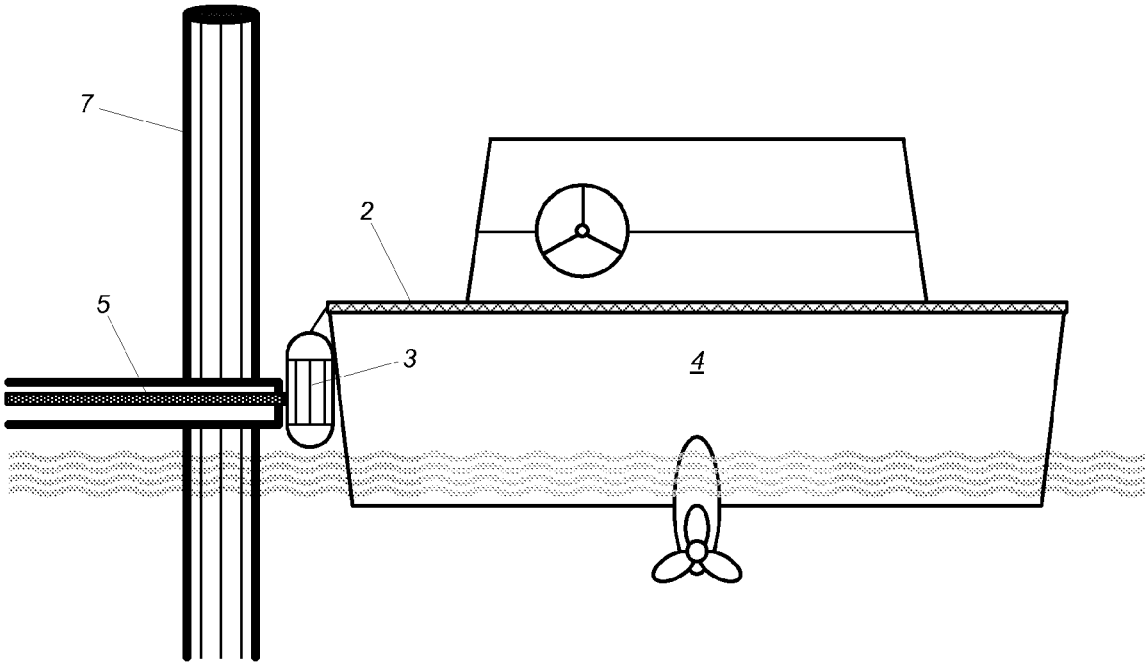
Fig. 1C (prior art)
FIG. 1C shows a prior art use of traditional fenders to cushion a vessel from a mooring.
Figure 1D:
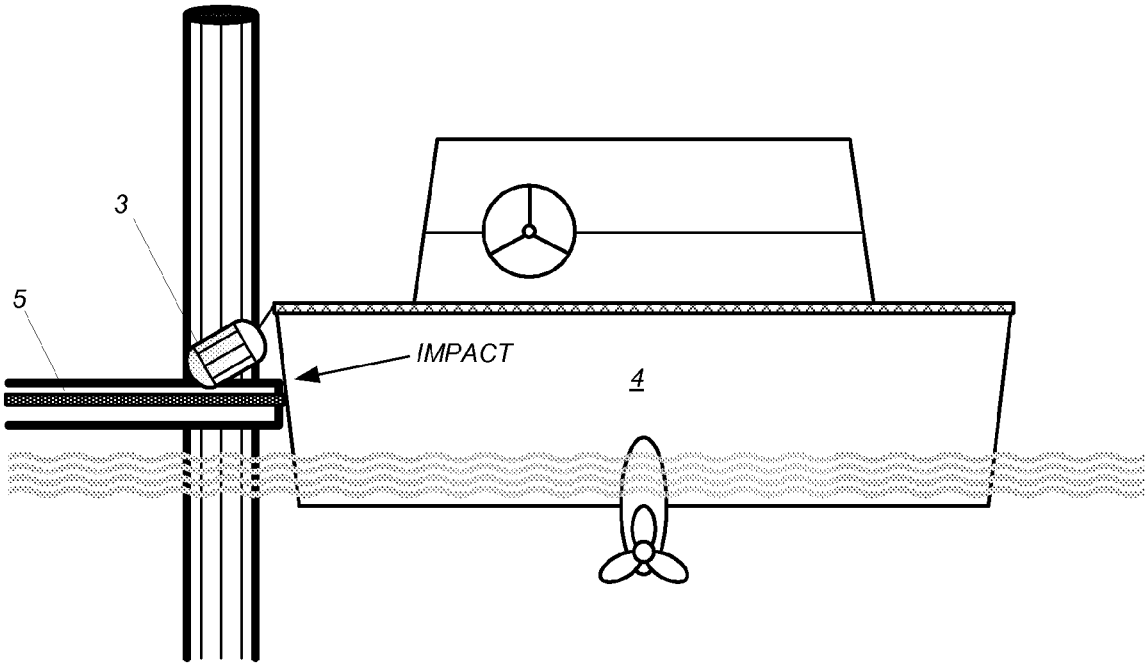
Fig. 1D (prior art)
FIG. 1D shows one example of displacement of a prior art fender.
Figure 1E:
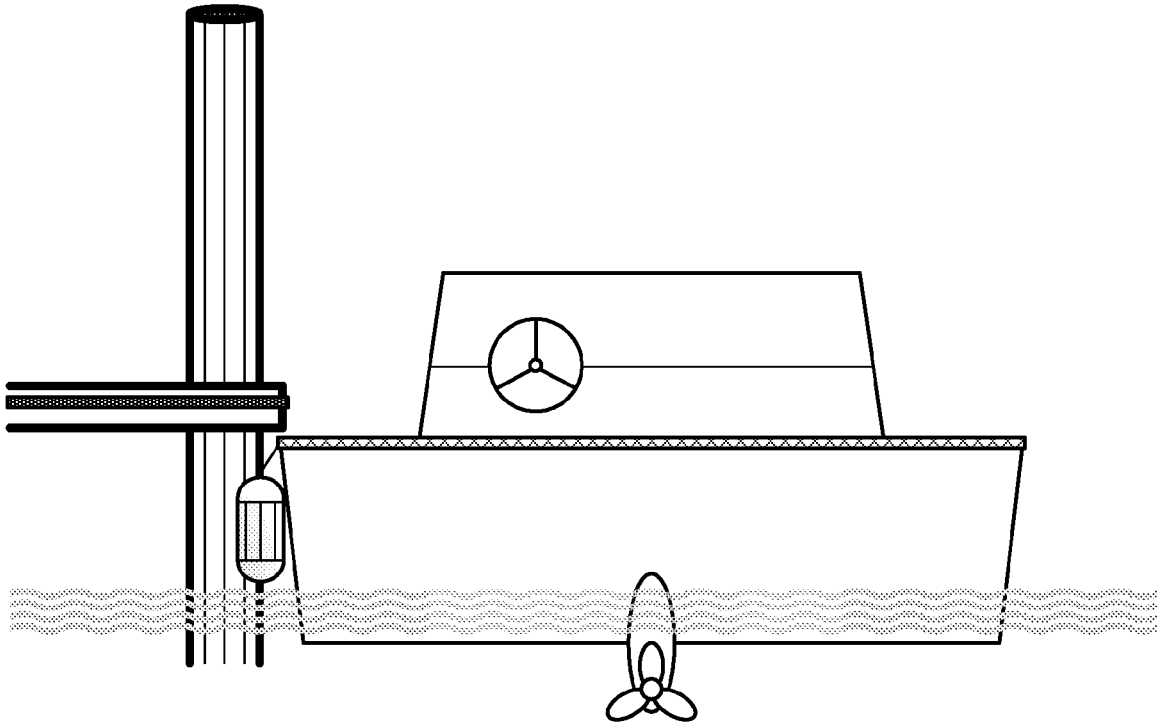
Fig. 1E (prior art)
FIGS. 1E-1F demonstrate an example of changing environmental conditions which may render prior art fenders ineffective.
Figure 1F:
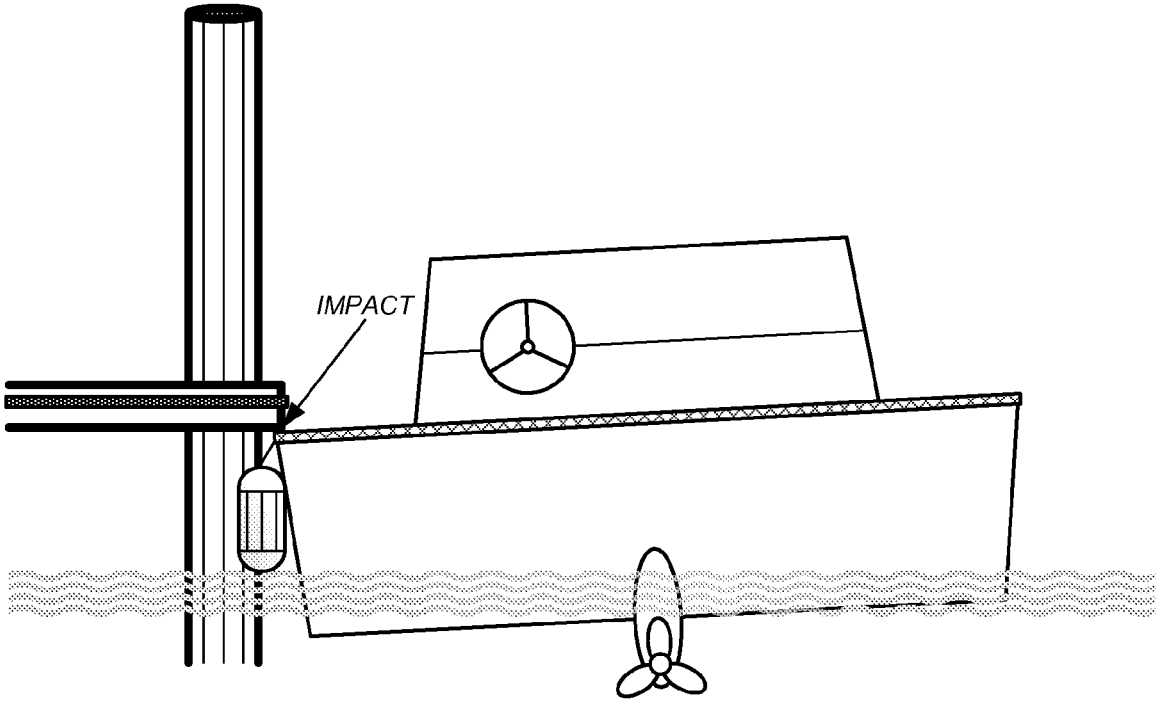
Fig. 1F (prior art)

As used herein, a "bumper system" is a system for absorbing shocks, impeding a collision or otherwise preventing damage that may result from an interaction between two or more objects. Other definitions of "bumper system" which do not depart from the spirit of the invention may also apply.

As used herein, a "substrate" is any object or surface to which something may be operatively connected. The operative connection may be of any type known in the art and may comprise any components, materials and/or combinations thereof. Because the vessels and structures referenced herein may include many different and varying components and comprise various configurations, the term "substrate" is used throughout to reference any thing or part thereof to which a component being described may be operatively connected. Commonly used examples of substrates used herein include intermediate members, vessels (or components thereof), terrestrial vehicles (or components thereof), and moorings (or components thereof). Other definitions of "substrate" which do not depart from the spirit of the invention may also apply.

As used herein, a "mooring" when used to describe a thing, is anything to which a vessel may be operatively connected such that the vessel and its mooring will maintain a desired (often relatively close) proximity. Moorings include, but are not limited to, structures (fixed or floating) and other vessels. The operative connection may be of any type known in the art. An operative connection with a mooring need not include a physical component and may occur solely through exertion of forces on a vessel and/or mooring that results in and/or maintains a relatively close proximity of the vessel and mooring. An operative connection with a mooring may be reversible. "Mooring," when used to describe an act, means the act of operatively connecting a marine vessel to a second marine vessel or a structure (which may be fixed or floating) or bringing the two into a desired proximity. The term "docking" may also be used to refer to one or more mooring maneuvers. Other definitions of "mooring" which do not render an embodiment non-functional may also apply.

The terms "seagoing vessel," "marine vessel," and "vessel" are used interchangeably herein and include any man-made craft or structure capable of navigating on or through water, whether under its own power, or due to the exertion of external forces.

As used herein, "rotatable member" means any member that is disposed such that it is rotatable about an axis. The member may be of any type or configuration known in the art. Rotation of the member may be accomplished through the operative connection between such a member and its substrate, and/or any configuration of the substrate and/or the member itself and/or using any other mechanism known in the art. An axis of rotation of a rotatable member may be perpendicular to a surface of the substrate to which the rotatable member is operatively connected. Alternatively, the axis of rotation may be disposed at any predetermined angle with respect to such a surface and may be variable. The rotatability of a rotatable member may be accomplished by any mechanism known in the art. Other definitions of rotatable member which do not depart from the spirit of the invention may also apply.

As used herein, "slideable member" means any member that is disposed such that it may be positionally displaced along a surface of an operatively-connected substrate. Although such movement need not be parallel to such a surface, it will typically be relatively parallel to the surface of the substrate. Such movement may also be described as "lateral displacement." Typically, such movement is reversible. Other definitions of slideable member which do not depart from the spirit of the invention may also apply.

As used herein, "extendable member" means any member that is disposed such that it is movable in a non-parallel direction relative to an operatively connected substrate, such that a gap is formed, or widened, between the extendable member and the substrate. In certain configurations, such movement may also be described as "outward displacement" of a member. Typically, such movement is reversible. Other definitions of extendable member which do not depart from the spirit of the invention may also apply.

As used herein, "moveable member" may be used generically to describe any member that is rotatable, slideable, extendable, and/or some combination thereof.

As used herein, "intermediate member" relates to a configuration of substrate which is used, or configured to be used, to connect one or more components of a bumper system to a second substrate. Use of intermediate members advantageously facilitates the configuration, packaging, sale, operation, and/or installation of one or more components of a bumper system according to various embodiments. For example, a plurality of moveable members may be operatively connected to a single intermediate member, thereby requiring formation of only a single connection (between the intermediate member and, e.g., a vessel hull) for installation. Intermediate members may be of any size or configuration. Configurations, uses, and advantages of intermediate members, are described in further detail below.

Figure 2:
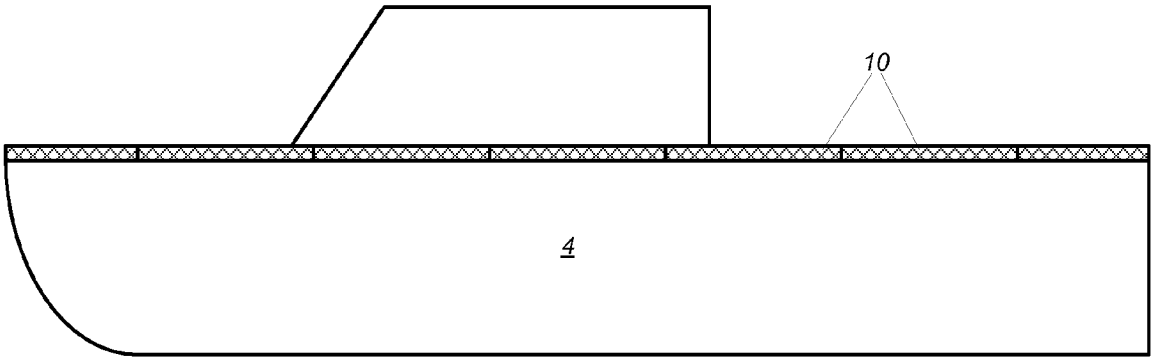
FIG. 2 shows a bumper system according to one embodiment of the invention.

As shown in FIG. 2, in one embodiment, a bumper system comprises one or more rotatable members 10. The rotatable members 10 are disposed at predetermined locations along a circumference of a hull 4 of a vessel or along the periphery of a floating or fixed structure. In one embodiment, the rotatable members 10 may be disposed such that they will function as a rubrail when not deployed (e.g., rotated to a desired position, laterally displaced, etc.).

Figure 3:
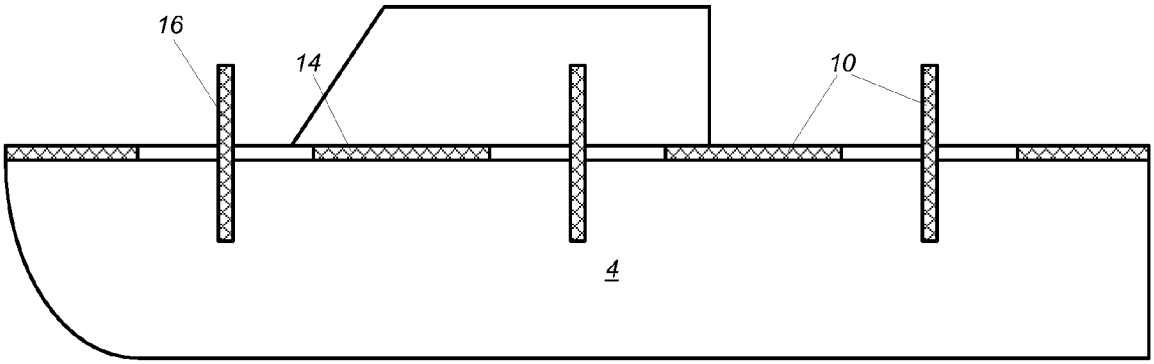
FIG. 3 shows a bumper system according to one embodiment of the invention, wherein a plurality of rotatable members are depicted in a deployed position.

As shown in FIG. 3, in one embodiment the bumper system comprises one or more rotatable members 10 that are rotatable from a first rotational position 14 to a second rotational position 16. In one embodiment, the rotatable members 10 shown at 14 and 16 are two discreet members which each maintain a fixed location along the length of a vessel hull 4 and are rotatable in that fixed location.

In one embodiment, 14 and 16 represent a positional displacement as well as a rotational displacement of the same rotatable member 10 (i.e., the rotatable member 10 represented at 16 is the same rotatable member represented at 14, after it has been moved towards the bow of the vessel and rotated). In such an embodiment, the rotatable member 10 may be operatively connected to a substrate such that the rotatable member 10 is slideable along a surface of the substrate. Such an embodiment advantageously allows a rotatable member 10 to be moved from a first location to a second location and also rotated to a desired rotational orientation. In one embodiment, the rotational and positional displacement of a rotatable member 10 are independent of each other. In one embodiment, rotational and positional displacement are linked such that, as the rotatable member 10 is laterally displaced, it will also rotate, or become rotatable. In one embodiment, as (or after) the rotatable member 10 is rotationally displaced, it will become laterally displaceable.

Although the first and second rotational positions of a rotatable member 10 may comprise any two rotational orientations, when not in use, a relatively horizontal position (or one in which the rotatable member 10 is oriented to follow a contour of a hull 4 or other operatively-connected substrate) advantageously reduces the obtrusiveness of the rotatable member 10 while in some cases providing protection similar to that provided by a traditional rubrail or bumper. A non-horizontal position advantageously provides greater protection against damage caused by certain interactions between a vessel and a mooring due to relative movement between the two, particularly movement having a vertical component. Rotatable members 10 may be used in conjunction with, or in place of, traditional protective devices such as rubrails, fenders and other protective apparatuses.

Any number of rotatable members 10 may be disposed at predetermined locations along the hull 4 of a vessel or perimeter of a structure. Furthermore, rotatable members 10 may be disposed such that spaces and/or non-rotatable members lie therebetween. The rotatable members 10 may be operatively connected directly to a hull 4 or other substrate and/or may be operatively connected to one or more intermediate members which are operatively connected/connectable to the hull 4 or other substrate.

Figure 4A:
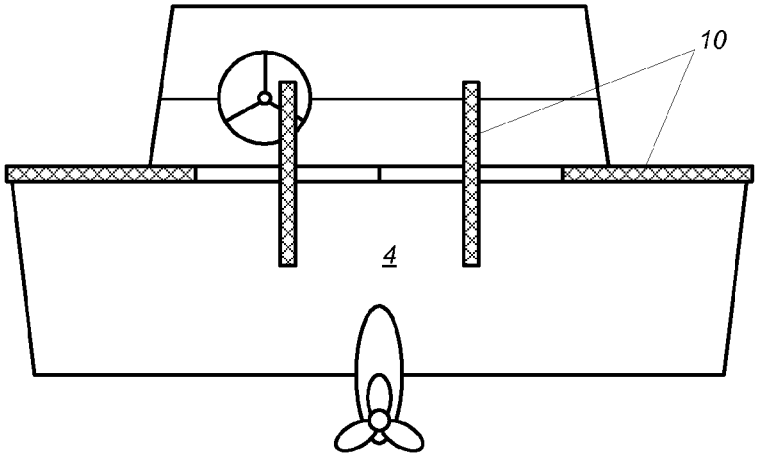
FIG. 4A shows a bumper system according to one embodiment of the invention, wherein a plurality of rotatable members are mounted on the stern of a vessel.

As shown in the embodiment of FIG. 4A, rotatable members 10 may be advantageously disposed at the stern of a vessel such that the vessel is protected when positioned such that its stern may contact another object. Any number of rotatable members 10 may be disposed at any location along the stern. Similar configurations may be used along the bow of a vessel.

Figure 4B:
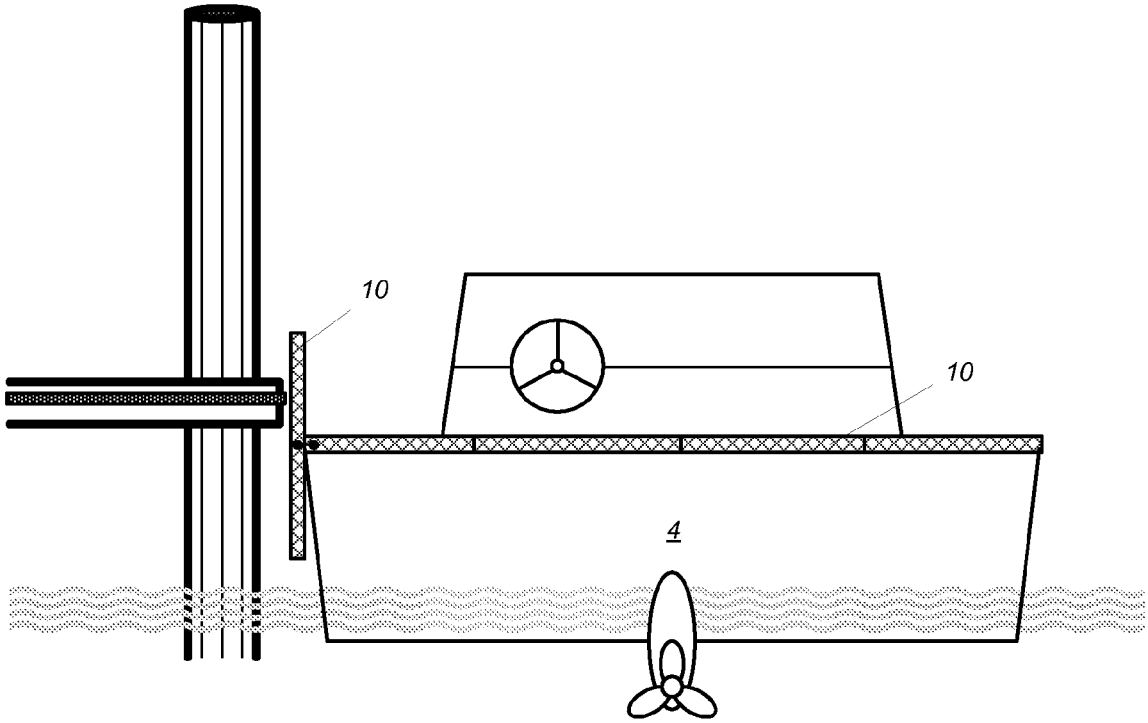
FIG. 4B shows a bumper system according to one embodiment of the invention, in use.
Figure 4C:
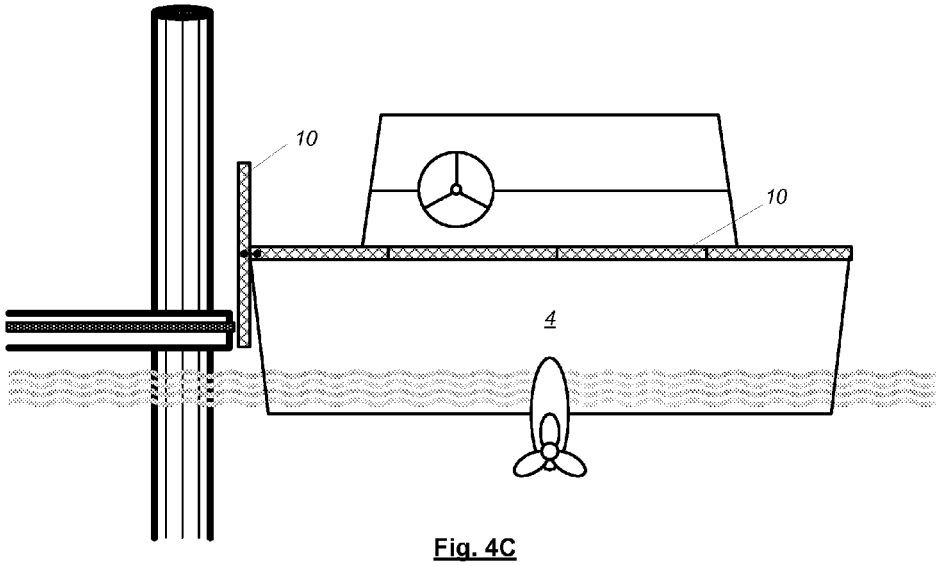
FIG. 4C shows a bumper system according to one embodiment of the invention, in use.

As shown in the embodiment of FIG. 4B, when deployed, a rotatable member 10 advantageously protects a vessel during docking maneuvers and/or when moored. Furthermore, in one embodiment the rotatable member 10, when properly deployed, advantageously prevents the slippage of a vessel under its mooring during conditions in which the vessel hull 4 is below a lip of the mooring (as shown in FIG. 4B), such as may occur due to a low tide, heavy load, wave action, and/or other conditions. As shown in FIG. 4C, in one embodiment, the rotatable member 10, when properly deployed, also advantageously protects a moored vessel from direct contact between its hull 4 and a mooring in conditions, such as high tide or light load, which result in the positioning of the vessel such that the hull 4 might contact the mooring.

Figure 5:
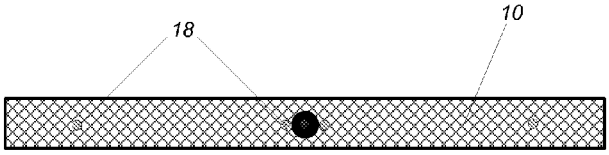
FIG. 5 shows retaining elements according to one embodiment of the invention.
Figure 6:
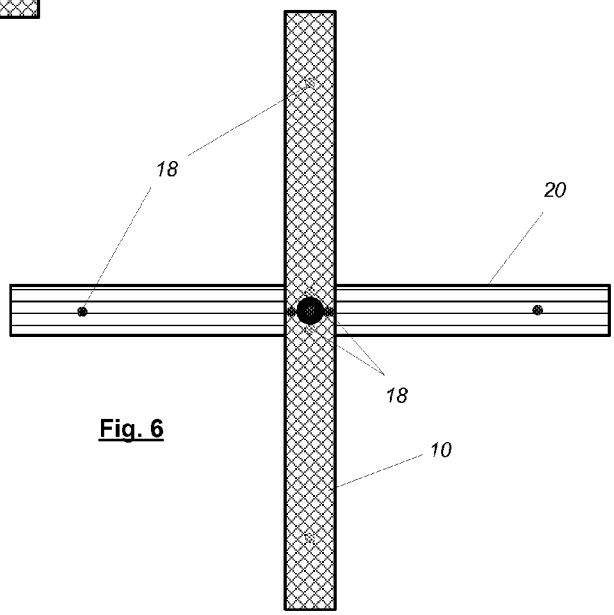
FIG. 6 shows retaining elements according to one embodiment of the invention.

Any mechanism known in the art may be used to achieve and/or maintain a desired rotational position of a rotatable member 10. In the embodiments of FIGS. 5 and 6, retaining elements 18 are used to rotationally stabilize a rotatable member 10 in a desired rotational position. One or more retaining elements 18 are disposed on the rotational member 10 and configured to interact with one or more retaining elements 18 disposed on an operatively connected substrate such as a vessel hull 4 or intermediate member 20. The number, type, and placement of retaining elements 18 may vary. In one embodiment, one or more retaining elements 18 are disposed such that they will rotationally stabilize a rotatable member 10 in a plurality of predetermined rotational positions. Retaining elements 18 may be disposed on adjoining rotatable members 10 and/or non-rotatable members such that the adjoining members will rotationally stabilize each other in a predetermined rotational orientation.

Retaining elements 18 may be of any type and/or configuration known in the art. In one embodiment, retaining elements 18 will comprise a combination of a convexity and a concavity disposed such that a rotational movement of the rotatable member 10 will align the convexity with the concavity resulting in at least a partial disposition of the convexity within the concavity. In one embodiment, one or more elements forming a rotationally operative connection between the rotatable member 10 and a substrate to which it is operatively connected will be configured to stabilize the rotatable member 10 in one or more predetermined rotational positions. For example, in one embodiment the operative connection between a rotatable member 10 and its substrate may comprise one or more gears capable of both rotating the rotatable member 10 and stabilizing the rotatable member 10 in one or more predetermined rotational positions. In one embodiment, one or more gears will be operatively connected to the rotatable member 10 and/or its substrate such that the one or more gears will stabilize the rotatable member 10 in at least one rotational position. In one embodiment, retaining elements 18 will include a magnetic component.

Figure 7A:
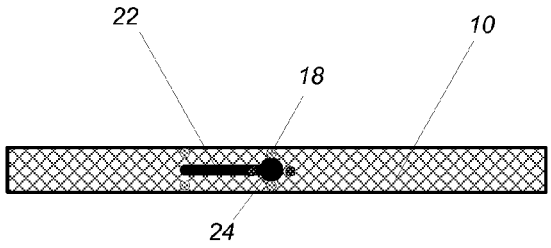
FIGS. 7A-7C show various configurations according to one embodiment of the invention.
Figure 7B:
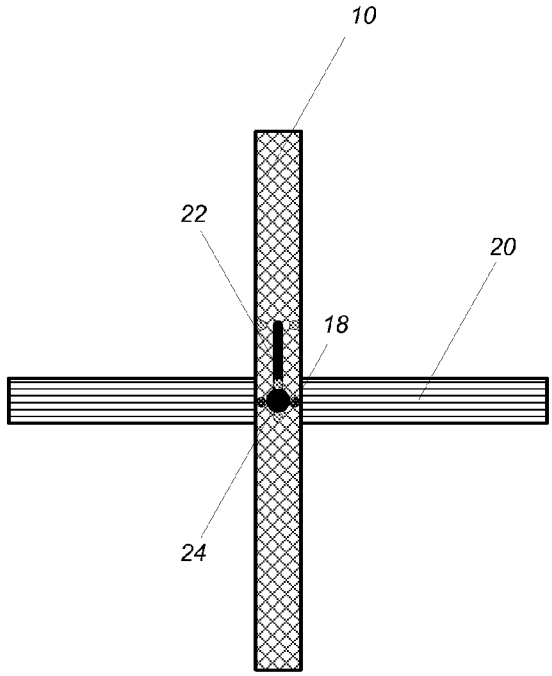
Figure 7C:
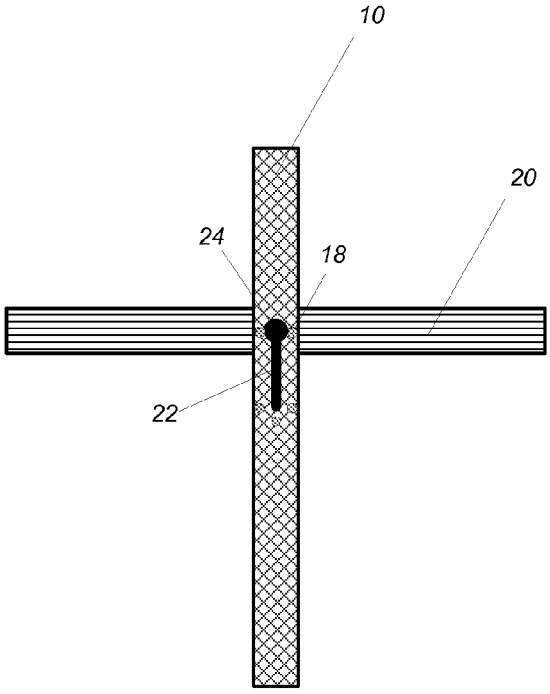

In the embodiments of FIGS. 7A-7C, a rotatable member 10, is operatively connected to a substrate such as an intermediate member 20. A groove 22 is disposed in either the rotatable member 10 or the substrate and configured such that a pin 24 or similar mechanism, disposed in the other member (i.e. the member which does not include the groove 22) may operatively connect to the groove 22. The pin 24 is displaceable within the groove 22 from a first location to a second location, allowing for a lateral displacement of the rotatable member 10 with respect to the substrate. A rotatable member 10 according to such embodiments may be rotated from a first rotational position to a second rotational position and may then slide (due to gravity or any other force exerted on the rotatable member 10) from a first position to a second position.

Displacement of the pin 24 within the groove 22 may allow the rotatable member 10 to be moved such that a resulting weight imbalance will advantageously stabilize the rotatable member 10 in a second position. For example, with reference to FIG. 7C, the rotatable member has moved downward with respect to the pin 24 and the resulting configuration has a greater mass below the pin 24 than above. The resulting weight imbalance will stabilize the rotatable member 10.

One or more retaining elements 18 may stabilize any desired rotational and/or laterally-displaced positions of the rotatable member 10. In one embodiment, the pin 24 or similar mechanism disposed within a groove 22 of a rotatable member 10 will also form the operative connection between the rotatable member 10 and a substrate. Such an embodiment advantageously simplifies the operative connection as well as the rotational and lateral displacement of the rotatable member 10.

Figure 8A:
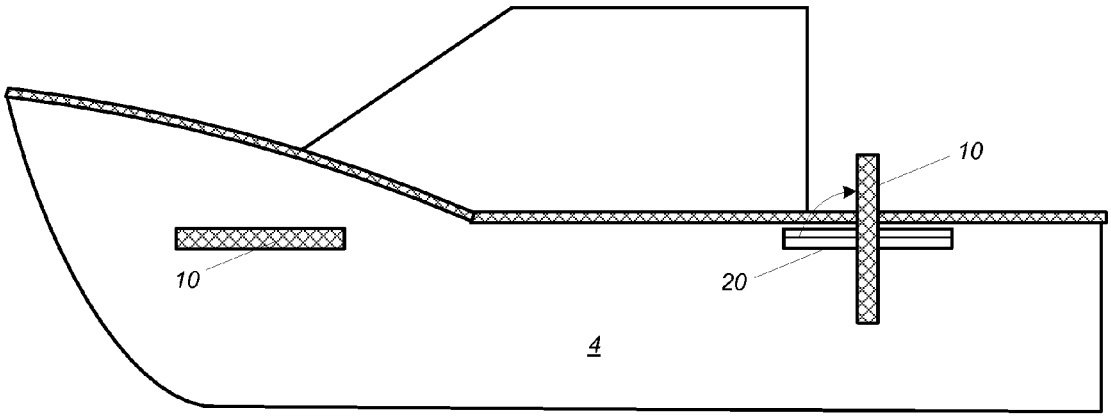
FIG. 8A shows one embodiment of a bumper system, disposed on a marine vessel.

As shown in FIG. 8A, in one embodiment, a bumper system may comprise a single intermediate member 20 operatively connected to a single rotatable member 10. The intermediate member 20 may be configured to operatively connect to vessel and/or mooring, may be integrated into the vessel and/or mooring during construction, and/or may include one or more components for reversibly connecting to a vessel and/or mooring. Such components may include, but are not limited to, suction cups, and adhesives. Such a configuration advantageously allows for the placement of individual rotatable members 10 at desired locations on a vessel (e.g., at desired locations along the hull 4) and/or mooring.

Figure 8B:
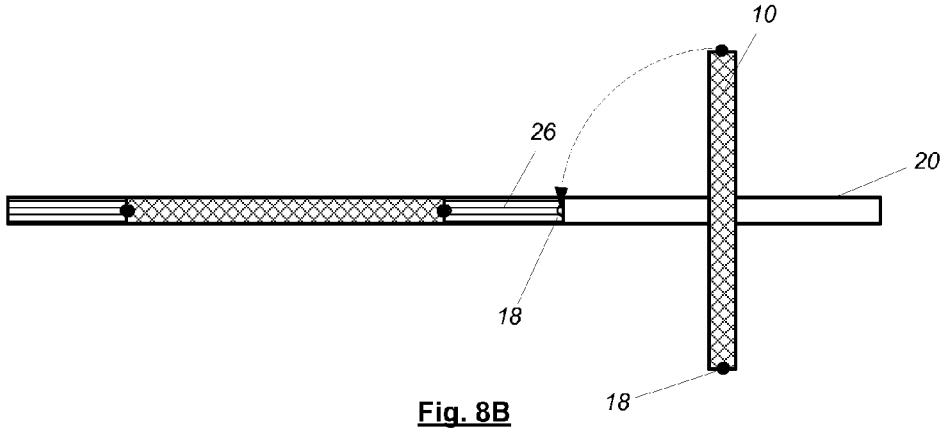
FIG. 8B shows one embodiment of a bumper system, wherein rotatable and non-rotatable members are disposed on an intermediate member.

In one embodiment, the invention comprises a single intermediate member 20 having a plurality of rotatable members 10 operatively connected thereto. As shown in FIG. 8B, in one embodiment, the invention comprises a single intermediate member 20 having at least one non-rotatable member 26 and at least one rotatable member 10 operatively connected thereto. Such configurations advantageously ease installation of a bumper system according to various embodiments of the invention. In one embodiment the non-rotatable member 26 is outwardly displaceable (extendable) relative to the intermediate member 20. The intermediate member 20 may be operatively connected to a side and/or top of a hull 4 or structure.

Referring again to FIG. 8B, a bumper system may comprise various sizes of rotatable members 10 and/or non-rotatable members 26. In one embodiment, non-rotatable members 26 may be positioned between rotatable members 10. In one embodiment, the intermediate member 20 may be configured such that sections thereof protrude such that such sections will be aligned with an outer surface of one or more operatively connected rotatable members 10. Such a configuration would advantageously simplify installation of embodiments of the bumper system.

In one embodiment, the non-rotatable members 26 may also include one or more retaining elements 18 configured to interact with one or more retaining elements 18 disposed on the rotatable members 10, such that the rotatable members 10 will be stabilized in a desired rotational position with respect to the non-rotatable members 26. The retaining elements 18 may be of any type known in the art and may include, but are not limited to, latches, and ball and socket mechanisms. The retaining elements 18 may be disposed on any one or more predetermined surfaces of the rotatable and/or non-rotatable members 10, 26. Retaining elements 18 may be configured to interact automatically when in proximity, or may require activation and/or deactivation by an operator. Retaining elements 18 may require physical manipulation by an operator, may occur remotely, or may require proximity to one or more other retaining elements 18 (e.g., magnetic retaining elements 18). In one embodiment, retaining elements 18 may be disposed on two adjacent rotatable members 10 such that the two rotatable members 10 will reversibly stabilize one another in a predetermined rotational orientation. In one embodiment, an intermediate member 20 or other substrate may also include one or more retaining elements 18 for rotationally stabilizing a rotatable member 10.

Figure 9:
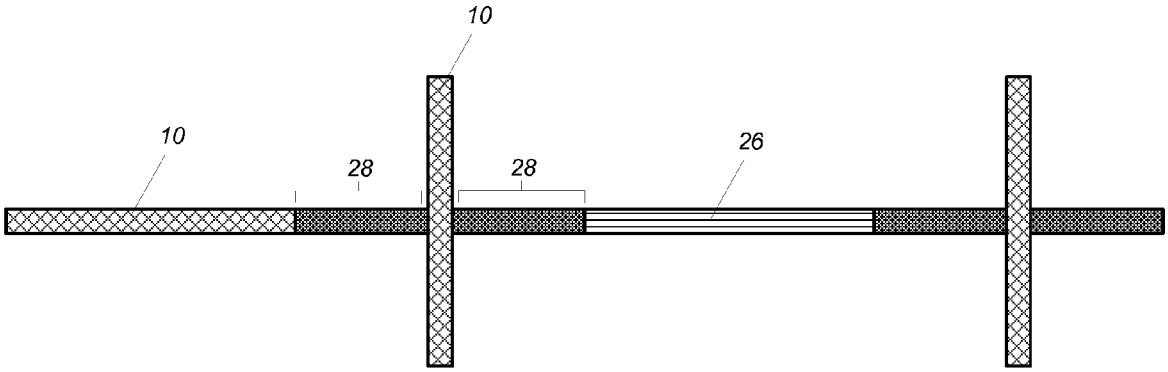
FIG. 9 shows one embodiment of a bumper system having both rotatable and non-rotatable rotatable members.

As shown in FIG. 9, in one embodiment, a substrate (e.g., a hull, intermediate member, or component of a mooring) to which a rotatable member 10 is operatively connected may comprise an outwardly-oriented compressible element. In one embodiment, non-rotatable members 26 may also comprise an outwardly-oriented compressible element. An advantage of disposing compressible elements on a substrate is the provision of a secondary zone of protection 28 in addition to that provided by the rotatable members 10. Compressible elements may be of any type known in the art, and may comprise any materials or combinations thereof.

Figure 10A:
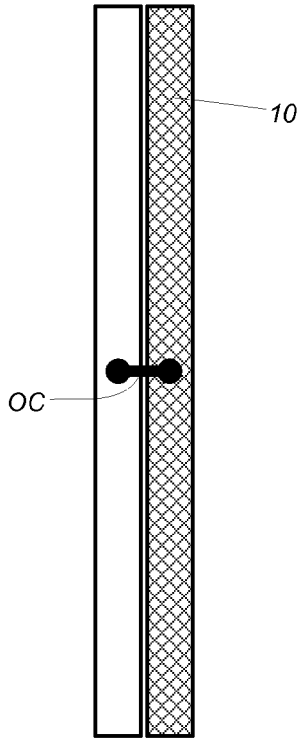
FIGS. 10A-10B show two configurations of a bumper system according to one embodiment.
Figure 10B:
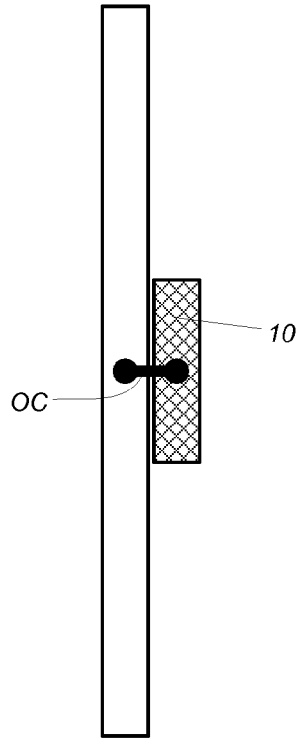

In the embodiment of FIGS. 10A-10B, a rotatable member 10 will maintain a relatively fixed proximity to the substrate to which it is operatively connected regardless of rotational and/or lateral displacement of the rotatable member 10. Such an embodiment advantageously provides a lessened protrusion of the rotatable member 10 regardless of rotational position, thereby lessening the likelihood that the rotatable member 10, and/or operative connection OC will be damaged by catching on lines, docks, and other objects. Although shown in close proximity in FIGS. 10A-10B, elements of a bumper system may be disposed in any desired proximity to each other.

Figure 11A:
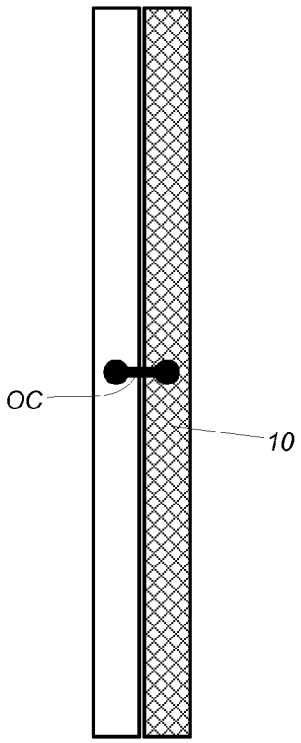
FIGS. 11A-11B show two configurations of a bumper system according to one embodiment.
Figure 11B:
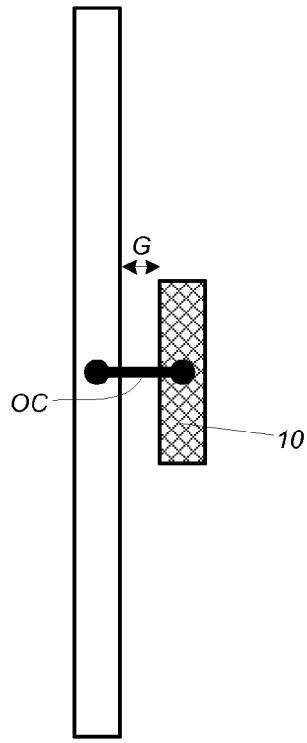

In the embodiment of FIGS. 11A-11B, a rotatable member 10 is outwardly displaceable. In one embodiment, outward displacement of the rotatable member 10 will occur as the rotatable member 10 is rotationally displaced from a first rotational position to a second rotational position. In one embodiment, outward displacement of the rotatable member 10 is reversed as the rotatable member 10 is rotationally displaced from a first rotational position to a second rotational position. In one embodiment, outward displacement will occur independently and be reversible without requiring a return of the rotatable member 10 to a prior rotational position. In one embodiment, outward displacement of the rotatable member 10 as it is displaced from a first rotational position will result in a fixed outward displacement. In one embodiment, the magnitude of outward displacement G (also referenced herein as a "gap") of the rotatable member 10 is adjustable and may be proportional to a predetermined degree of rotational displacement. In one embodiment, a predetermined gap G will correspond to a predetermined rotational orientation.

The mechanism for outward displacement (i.e., extension) of a rotatable member 10 and/or the reversal of such outward displacement may be of any type known in the art. In one embodiment, the operative connection OC between rotatable member 10 and substrate will include a mechanism for outward displacement of a rotatable member 10 and/or the reversal of such outward displacement. In one embodiment, the operative connection OC may be threaded such that rotation of the rotatable member 10 in one direction will increase the size of a gap G and rotation in the opposite direction will decrease the size of gap G. In one embodiment, the operative connection OC may comprise a gear or other mechanism that permits the creation, expansion, and reversal of the gap G. In one embodiment, a gap G may be formed, expanded, and decreased without rotating the rotatable member 10. In one embodiment, similar gap-forming and reversing mechanisms may be used with non-rotatable members 26 and/or any other components of a bumper system.

Figure 11C:
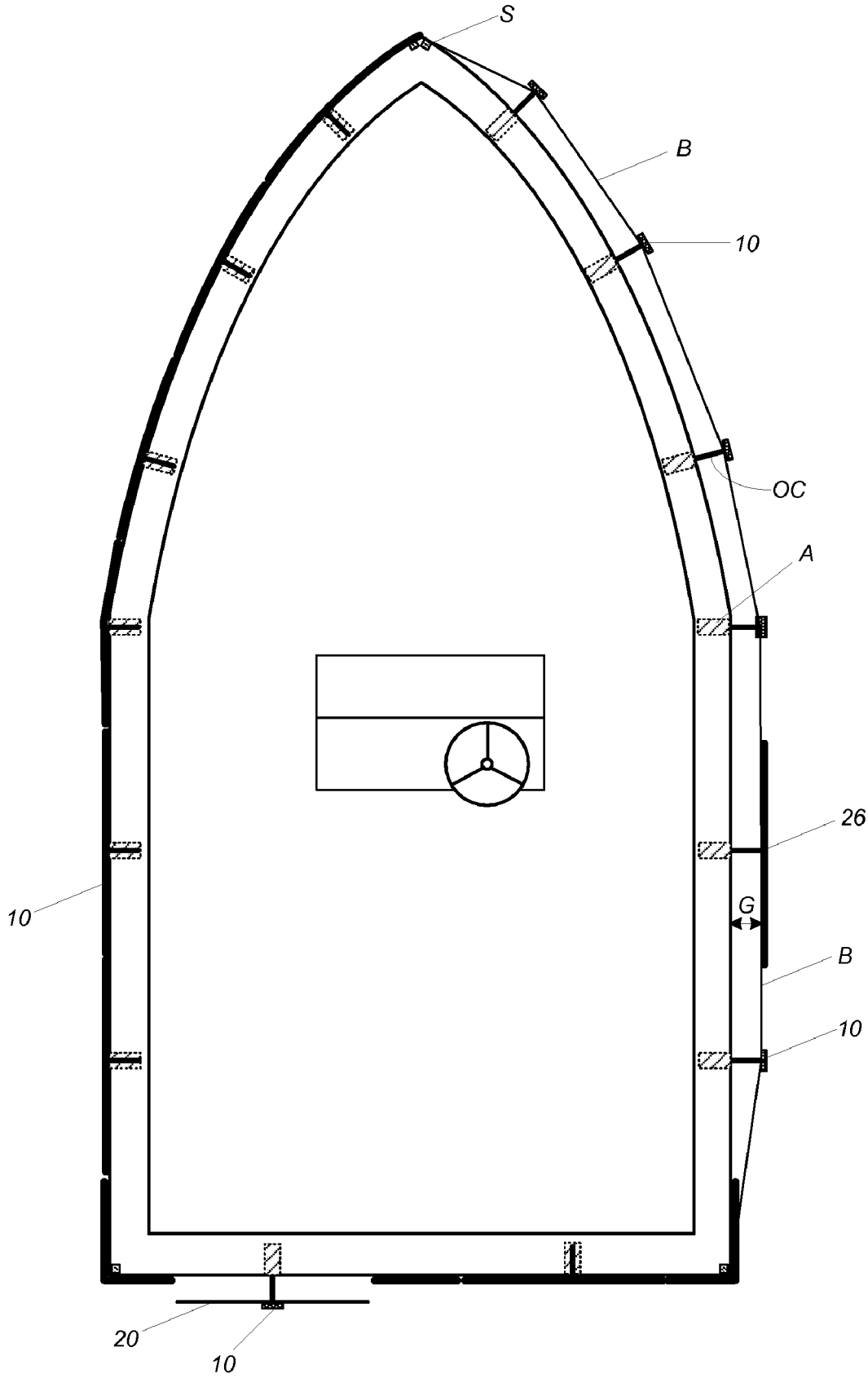
FIG. 11C shows various embodiments of a bumper system, disposed on a marine vessel.

As shown in the embodiments of FIG. 11C, various approaches may be used to prevent the penetration of pilings and/or other components of a mooring, or other objects, into the space(s) between outwardly deployed rotatable members 10 and/or non-rotatable members 26, which might otherwise result in damage to the rotatable and/or non-rotatable members 10, 26 and/or operative connections OC. In one embodiment, it may be desirable to outwardly displace an intermediate member 20 and/or non-rotatable member 26 in conjunction with the outward displacement of one or more rotatable members 10, thereby preventing penetration of undesirable objects into the area of the gap G that is formed by such outward displacement.

In one embodiment, a boundary B may be formed by additional components, which may comprise any material(s) and/or configuration known in the art. In one embodiment, the boundary B comprises a belt or rope. Tensioning of the boundary B may be facilitated by the use of mechanisms such as springs or spools (represented generally at S) which will provide a predetermined degree of tension along the boundary B, possibly by winding excess boundary material or exerting pressure on same. The boundary B may be operatively connected to any one or more components of the bumper system such that it will be outwardly displaced in conjunction with such components, thereby protecting the gap G from penetration of undesirable objects, such as pilings.

The boundary B may also comprise an elastic material which is stretched by the outward displacement of the members (e.g., rotatable members 10, non-rotatable members 26, and operative connection OC) to which the boundary B is operatively connected. Utilizing such a system, a boundary B may be formed around a vessel and/or mooring, and/or any portions thereof. Deployed rotatable members 10 will provide increased protection in a vertical plane while non-deployed rotatable members 10 and non-rotatable members, along with any boundary B formed, will provide increased protection in the horizontal plane.

Any mechanism known in the art may be used to outwardly displace, and/or reverse an outward displacement of, a rotatable member 10, and/or non-rotatable member 26. In one embodiment, the mechanism will comprise one or more actuators A. Actuators A may be of any type known in the art, including but not limited to hydraulic and electric actuators.

Figure 11D:
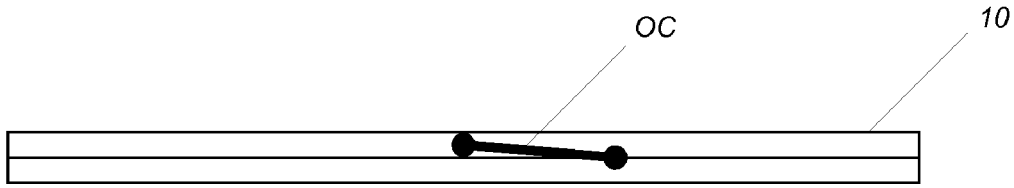
FIGS. 11D-11H show various configurations of embodiments of a bumper system.
Figure 11E:
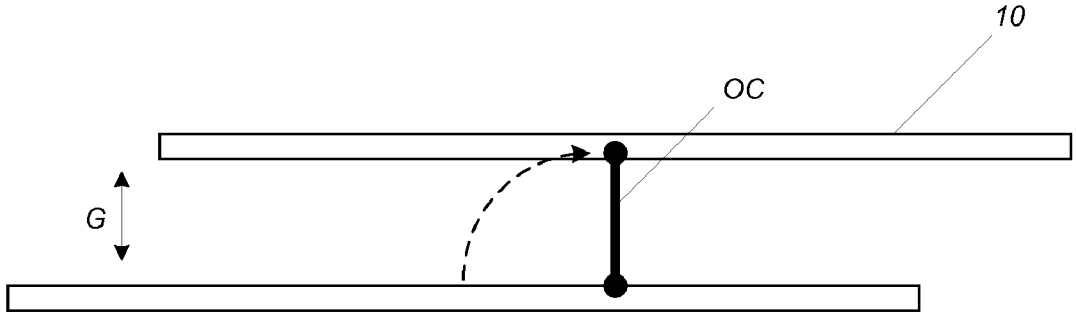
Figure 11F:
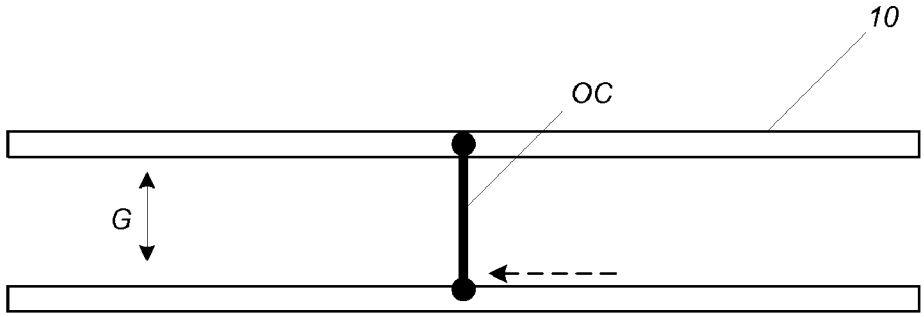

As shown in the embodiments of FIGS. 11D-11F, in one embodiment the operative connection OC may connect an off-center location of an underlying section of substrate to a central location of the rotatable member 10 (FIG. 11D). In one embodiment, the operative connection OC will be configured to pivot such that the rotatable member 10 will be outwardly displaced from its substrate, forming a gap G between the rotatable member 10 and substrate (from the orientation of FIG. 11D to that of FIG. 11E). In one embodiment, the point of connection of the operative connection OC with the substrate and/or rotatable member 10 may change during or after pivoting of the operative connection (from the orientation of FIG. 11D to that of FIG. 11F). In one embodiment, a rotatable member 10 having a pivoting operative connection will be rotatable only after the pivoting operative connection has completed a predetermined range of movement.

Figure 11G:
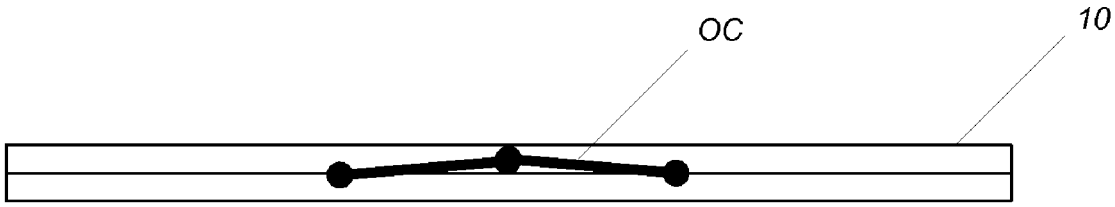
Figure 11H:
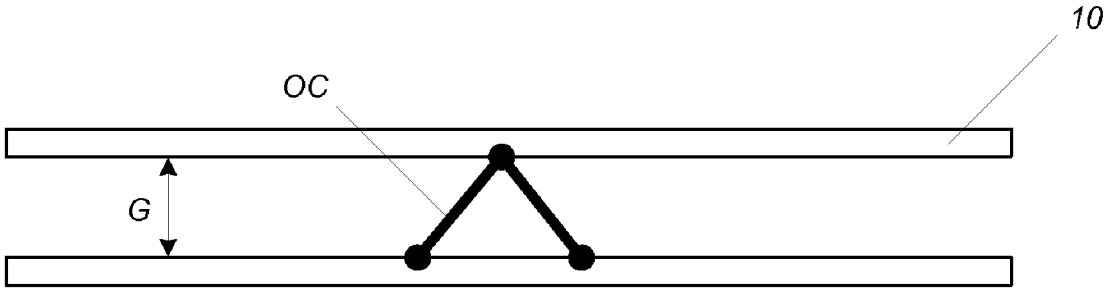

FIGS. 11G-11H demonstrate one embodiment of an operative connection OC. In this embodiment, the operative connection OC comprises a single connecter at one end and a pair of connecters at the other, thereby advantageously forming a stabilized configuration when deployed. In one embodiment, deployment of such a configuration may be achieved by bringing the paired connectors of the operative connection OC in closer proximity with one another. This may be achieved by any means known in the art, including the use of worm gears to move the paired connectors towards or away from each other such that the gap G is enlarged or decreased. Distancing of the paired connectors from each other will reverse the outward deployment of such an embodiment.

Figure 12A:
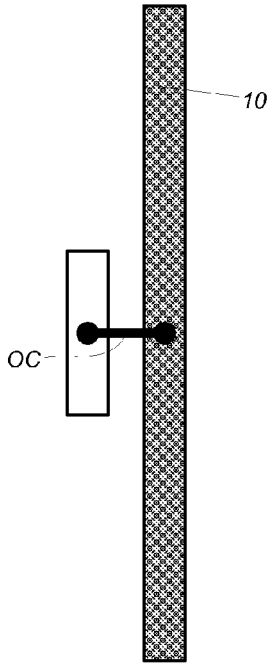
FIGS. 12A-12C show various configurations of embodiments of a bumper system.
Figure 12B:
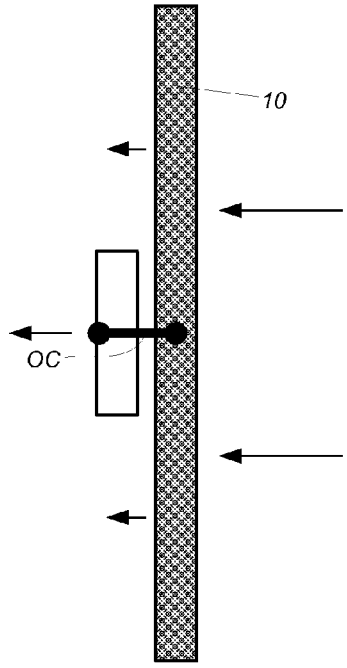
Figure 12C:
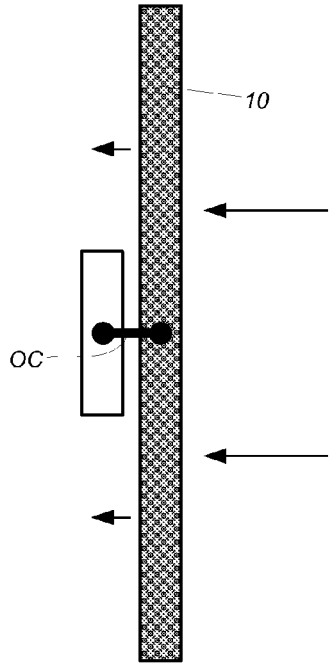

As shown in the embodiments of FIGS. 12A-12C, the operative connection OC between substrate and an outwardly displaced and rotated rotatable member 10 may function as a shock absorber, advantageously resulting in greater protection of a vessel and/or mooring during contact. The operative connection OC may be of any type known in the art that permits or facilitates a desired shock-absorbing effect. Configurations may include, but are not limited to, those including springs, elastic components, and/or pneumatics. In one embodiment, a rotatable member 10 is operatively connected to one or more shock absorbing mechanisms, which may be of any type known in the art. In such an embodiment, the operative connection OC will be displaced in conjunction with the rotatable member 10 to which it is operatively connected (FIG. 12B). In one embodiment (FIG. 12C), the operative connection OC between rotatable member 10 and substrate comprises both a rotational component and a shock-absorbing component. Either component may be of any type known in the art.

In one embodiment, rotatable members 10 of a bumper system may be individually rotated. In one embodiment, predetermined combinations of rotatable members 10 may be rotated together. Rotation of a rotatable member 10 may be manually initiated, completed, and/or reversed. In one embodiment, one or more rotatable members 10 may be rotated and/or extended remotely, using any mechanism known in the art. In one embodiment, controls disposed at the helm of a vessel will allow an operator to rotate and/or extend at least one rotatable member 10 from a first rotational position to a second rotational position.

Rotatable members 10 and/or non-rotatable members 26 of a bumper system according to various embodiments described herein may comprise any material or combination of materials known in the art and may further comprise any configuration known in the art that does not prevent a desired functionality of a particular embodiment. A rotatable member 10 may be configured to be easily manipulated by hand (e.g., may be configured to facilitate gripping). Furthermore, a rotatable member 10 may be expandable. In one embodiment, a rotatable member 10 is inflatable. Inflation may be manually or automatically initiated, and may be reversible.

Figure 13:
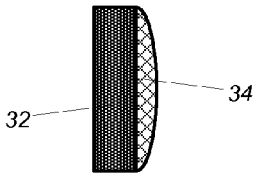
FIG. 13 is a cross-sectional view of one embodiment of a bumper system member.

A member (rotatable or non-rotatable) may comprise a plurality of sub-members. As shown in the embodiment of FIG. 13, a member may comprise at least one support member 32 and at least one compressible element 34. The compressible element 34 is operatively connected to the supporting element 32 such that the compressible element 34 will be outwardly-oriented when integrated into a bumper system according to various embodiments of the invention. In one embodiment, the compressible element 34 comprises one or more elastic materials such that the compressible element 34 will revert to a predetermined configuration when not compressed. In one embodiment, the supporting element 32 comprises a material or combination of materials that will allow a predetermined amount of flex of the supporting element 32. Such flex, alone or in combination with the compressibility of the compressible element 34, provides additional protection against damage from contact with a vessel and/or mooring.

Figure 14A:
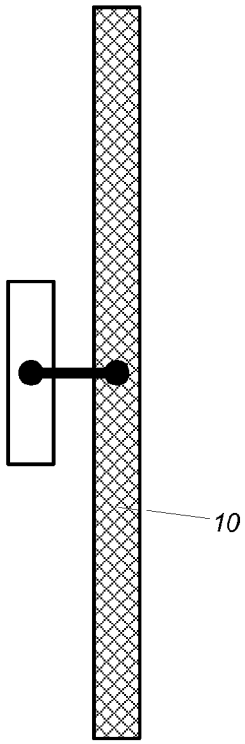
FIGS. 14A-14B show one embodiment of a bumper system having a flexible member.
Figure 14B:
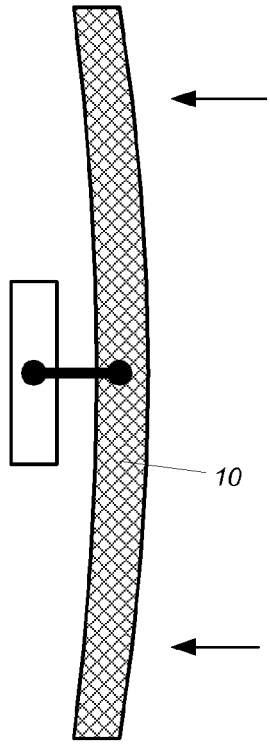

Rotatable members 10 according to various embodiments of the invention may be flexible and/or tiltable. As shown in the embodiment of FIGS. 14A-14B, a rotatable member 10 may be configured so that it will flex when forces are exerted at various locations along its length. Any materials and/or configurations known in the art may be used to provide a desired degree of flexibility to the rotatable member 10.

Figure 15A:
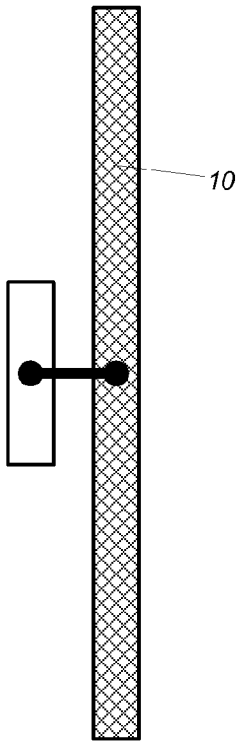
FIGS. 15A-15B show one embodiment of a bumper system having a tiltable member.
Figure 15B:
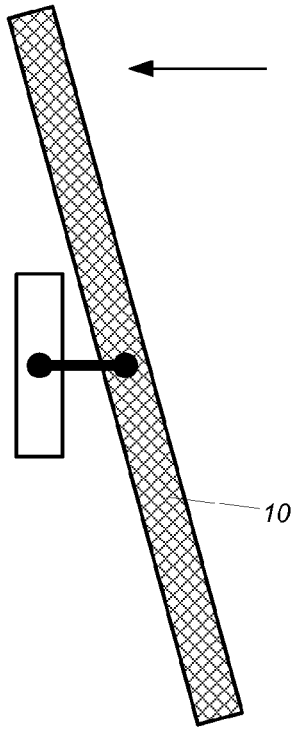

As shown in the embodiment of FIGS. 15A-15B, a rotatable member 10 may tilt in reaction to contact forces. The amount and direction of tilt may be predetermined. In one embodiment, a bumper system is configured such that an operatively connected rotatable member 10 will have a predetermined tilt bias. Such bias may be either inboard or outboard and may be of any desired magnitude. The mechanism by which the tiltability of a rotatable member 10 is achieved may be of any type known in the art and may be disposed in the substrate, the operative connection, at any location in the rotatable member 10, and/or any combination thereof. In one embodiment, a tiltable rotatable member 10 will be biased to maintain a non-tilted position when not subjected to off-axis forces.

Flexing and/or tilting of a rotatable member 10 will advantageously provide greater protection during contact with a vessel and/or mooring and will further provide increased durability of the bumper system due to a decreased likelihood of breakage of a rotatable member 10 when stressed at an off-center location as well as the ability to dissipate contact forces exerted during mooring or other contact. Off-axis forces exerted against a rotatable member 10, which might normally lead to damage to the rotatable member 10, operative connection, and/or substrate may advantageously be diffused through the tilting and/or flexion of the rotatable member 10. Non-rotatable members 26 and/or intermediate members 20 may also be configured to be flexible, tiltable, and/or shock-absorbing.

A bumper system according to various embodiments of the invention may be operatively connected to a vessel, mooring, or other object by any mechanism known in the art. In one embodiment, a bumper system is configured to be retrofit to an existing vessel or structure. In one embodiment, a bumper system comprises at least one intermediate member 26 operatively connected to at least one rotatable member 10. The intermediate member is configured to be operatively connected to a vessel, mooring, or other structure. The operative connection of an intermediate member to a vessel, mooring, or other structure may be of any type known in the art, and may include the use of backing plates and/or other devices known in the art to strengthen or support an operative connection, particularly under varying loads.

Figure 16A:
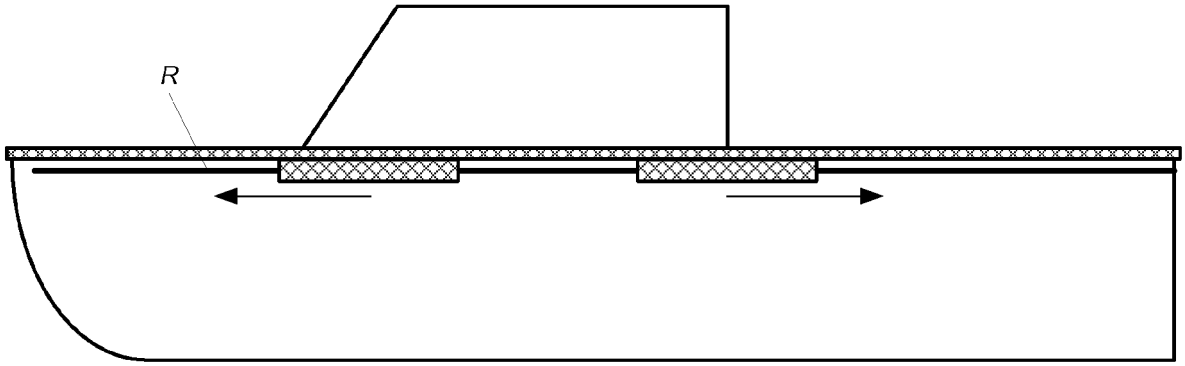
FIGS. 16A-16B show one embodiment of a bumper system having a guide rail.
Figure 16B:
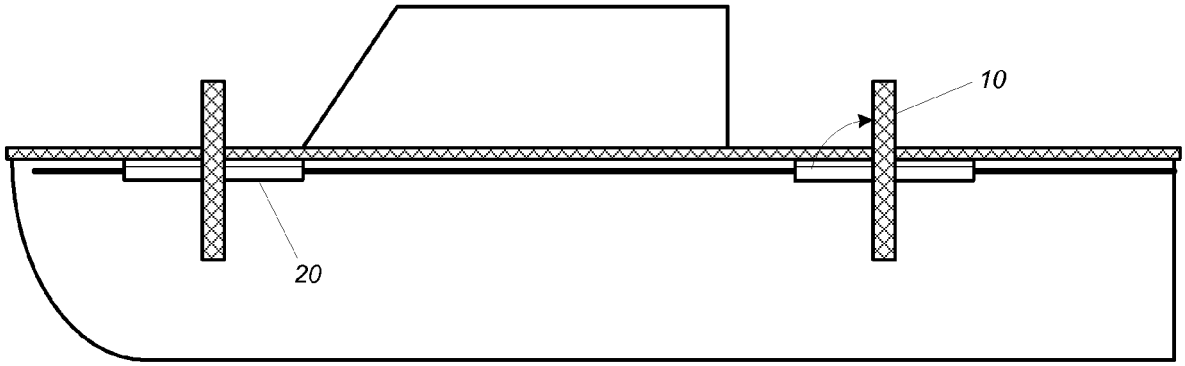

As shown in the embodiments of FIGS. 16A-16B, a bumper system may be configured to include one or more rotatable members 10 which are laterally displaceable along the length of one or more guide rails R, or similar devices. Such a configuration advantageously allows for the positioning of one or more rotatable members 10 at desired locations prior to, during, or after rotation. Such a configuration also advantageously allows for the use of a reduced number of rotatable members 10 while providing flexibility with respect to the deployment of such rotatable members 10. Embodiments such as shown in FIGS. 16A-16B may also be used with non-rotatable members 26 (not shown) or a combination of rotatable members 10 and non-rotatable members 26. Furthermore, such configurations may be utilized on structures as well as vessels.

The operative connection between a rotatable member 10 and guide rail R may comprise any type known in the art and may include one or more intermediate members 20. Furthermore, embodiments of a bumper system having a guide rail R may also utilize any configuration described herein with respect to outward displacement of one or more members, configuration of one or more members, and/or shock-absorbance of one or more members. A guide rail R may comprise any device or mechanism known in the art to permit a desired positional displacement of an operatively connected object.

In one embodiment, a bumper system comprises an intermediate member operatively connected to a plurality of rotatable members 10 and configured to fit a predetermined structure or vessel. Such predetermined configurations advantageously simplify the retrofitting of existing vessels or structures with a bumper system according to embodiments of the invention. In one embodiment, the invention comprises a method for operatively connecting a bumper system to an existing vessel or structure according to any of the configurations described herein.

In one embodiment, the bumper system is integrated into a vessel or structure during construction. In such an embodiment, one or more components of the vessel or structure may be configured to operatively connect to a predetermined number and configuration of rotatable members 10. The operative connection may be direct (i.e., a component of the vessel or structure forms the substrate for operative connection of a rotatable member 10) or may comprise one or more intermediate members. In one embodiment, the invention comprises a method of integrating a bumper system into a vessel or structure during construction.

In one embodiment, the operative connection of a rotatable member 10 to its substrate is reversible. Such a configuration advantageously eases the replacement and/or repair of a rotatable member 10. A reversible operative connection may also be advantageously used with one or more non-rotatable members 26.

In one embodiment, the invention comprises a method for using a bumper system comprising at least one rotatable member 10. The method comprises rotating the at least one rotatable member 10 in anticipation of, or during, a docking maneuver, and mooring a vessel alongside a mooring such that the at least one rotatable member 10 is deployed between the mooring and the vessel.

A first position and a second position of a rotatable member 10 according to embodiments of the invention may comprise any two rotational orientations of the rotatable member 10. First and second positions include, but are not limited to the relatively horizontal and relatively vertical positions depicted in the majority of the accompanying figures and include any desired degree of rotation. A first position and a second position of an extendible member according to embodiments of the invention may comprise any two outward displacements, relative to an operatively-connected substrate.

Shock-absorbing, flexing and/or tilting configurations as described herein may also be used with non-rotatable members 26. Such non-rotatable members 26 may be of any configuration known in the art, and may have any rotational orientation. For example, various embodiments described herein may be used with non-rotatable members 26 such as may be used with a tugboat and would advantageously provide a decreased likelihood of damage to the tugboat and/or any floating object with which the tugboat interacts.

Any mechanism known in the art may be used to impart a desired rotation to a rotatable member 10. Furthermore, a rotatable member 10 may be operatively connected to a substrate such that the rotatable member 10 may freely rotate about a rotational axis. One or more rotating mechanisms may be disposed in a member, a substrate, an operative connection, and/or any combination thereof, to impart a desired degree of rotation to a rotatable member 10.

In one embodiment, a rotatable member 10 may be manually operated by a user, including initiation of rotation from a first position, rotation to a second position, and/or the return of the rotatable member 10 to a previous rotational position. Any mechanism known in the art may be used to lock a rotatable member 10 in a particular rotational orientation. Such mechanisms include but are not limited to those that fix the rotational orientation with respect to a second rotatable member 10, a non-rotatable member 26, a substrate, an operative connection, and/or any combination thereof.

The rotational axis may be the point at which the rotatable member 10 is operatively connected to its substrate. Alternatively, the rotational axis may differ from the point of operative connection. Where the rotatable member 10 is freely rotatable, one or more mechanisms may be used to maintain a desired rotational position of the rotatable member 10. Such mechanisms may be of any type known in the art and may be disposed in the rotatable member 10, substrate, operative connection and/or any combination thereof. In one embodiment, a freely rotatable rotatable member 10 will include a mechanism for locking it in a first position when not in use, or when a rotational movement of the rotatable mechanism is not desired.

The axis of rotation of, and/or operative connection to, a rotatable member 10 may be located anywhere along the length of a rotatable member 10. An axis of rotation at or near the middle of a rotatable member 10 will advantageously allow ease of rotation as well as easier maintenance of various rotational positions. It may also be desirable to dispose the axis of rotation at an off-center location (i.e., not in or near the middle of a longitudinal surface of a rotatable member 10) so that gravity and/or other forces will maintain a desired rotational position, such as a relatively vertical position. A freely rotatable and/or tiltable configuration and/or one in which the axis of rotation is displaced from the middle of the rotatable member 10 may advantageously permit a movement of the rotatable member 10 to maintain a position to which it is biased by gravity or other forces. Such an embodiment advantageously allows the rotatable member 10 to compensate for movement of a vessel or structure to which it is operatively connected and maintain a relatively fixed rotational orientation while maintaining rotational freedom. Similarly, it may be desirable to configure a rotatable member 10 such that it is asymmetrical along its length, which may bias it towards maintaining a particular rotational orientation. For example, if a rotatable member 10 is configured such that a first end is heavier than a second end, the rotatable member 10 will be biased towards a rotational orientation in which the second (heavier) end is oriented downwardly.

In various embodiment, the axis of rotation of a rotatable member 10 may be relatively perpendicular to a surface of a substrate to which the rotatable member 10 is operatively connected. In such embodiments, the rotatable member 10 will be rotatable in a plane that is relatively parallel to the surface of the substrate to which the rotatable member 10 is operatively connected. In various embodiments, the axis of rotation of a rotatable member 10 will be tilted or tiltable with respect to a line perpendicular to the surface of a substrate to which the rotatable member 10 is operatively connected.

Various embodiments of a bumper system as described herein may also be disposed on moorings, including but not limited to stationary structures such as docks, and relatively stationary structures such as floating offshore platforms.

Any component described herein may be of any material or combination of materials known in the art. Furthermore, components may vary in size, structure, and configuration.

Although embodiments of the bumper system described herein have been described with respect to marine applications, embodiments of the bumper system may also be effective in non-marine applications. Such applications include, but are not limited to use with terrestrial vehicles and/or objects with which they may interact.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A bumper system, comprising:

at least one moveable member operatively connected to an outward-facing surface of an underlying substrate, the substrate comprising one selected from (a) a component of a marine vessel, and (b) a component of a terrestrial vehicle, such that in a non-deployed configuration an inward-facing rear surface of the at least one moveable member is substantially parallel and adjacent to the outward-facing surface of the underlying substrate; and at least one mechanism operatively connected to the substrate and to a location substantially at the longitudinal midpoint of the moveable member, to permit at least one predetermined movement of the moveable member, such movement selected from:

(a) rotation in a plane substantially parallel to the outward-facing surface of the substrate, (b) sliding in a plane substantially parallel to the outward-facing surface of the substrate, and (c) extension in a plane substantially perpendicular to the outward-facing surface of the substrate such that a desired gap is formed between the inward-facing rear surface of the moveable member and the operatively connected opposed surface of the underlying substrate.

2. The bumper system of claim 1, wherein the at least one predetermined movement is reversible.

3. The bumper system of claim 1, wherein the substrate further comprises an intermediate member.

4. The bumper system of claim 1, wherein the at least one mechanism is disposed in the operative connection between the at least one moveable member and the substrate.

5. The bumper system of claim 1, further comprising at least one retaining element for maintaining at least one predetermined position of the at least one moveable member.

6. The bumper system of claim 1, wherein the at least one mechanism is configured to be remotely activated.

7. The bumper system of claim 1, wherein the at least one moveable member comprises at least one compressible element.

8. The bumper system of claim 1, wherein at least one selected from 1) the at least one moveable member, 2) the operative connection between the at least one moveable member and the substrate, and 3) the substrate, is configured to be at least one selected from tiltable, shock-absorbing, and flexible.

9. The bumper system of claim 1, wherein the mechanism comprises an actuator.

10. The bumper system of claim 1, wherein the mechanism comprises a pin and groove configuration.

11. The bumper system of claim 1, further comprising a boundary.

12. The bumper system of claim 11, further comprising a tensioning mechanism operatively connected to the boundary.

13. The bumper system of claim 1, wherein the mechanism is configured such that a first predetermined movement occurs concurrently with a second predetermined movement.

14. The bumper system of claim 1, wherein the operative connection between the moveable member and the substrate comprises a guide rail.

15. A bumper system kit, comprising:

at least one moveable member, and an intermediate member comprising an outward-facing surface operatively connected to a location substantially at the longitudinal midpoint of the at least one moveable member, such that:

(i) a longitudinal axis of the at least one moveable member, and an inward-facing rear surface thereof, are both substantially parallel to the outward-facing surface of the underlying intermediate member, with substantially no gap therebetween when the at least one moveable member is in a non-deployed configuration, the outward-facing surface of the underlying intermediate member being that surface facing the inwardly-facing rear surface of the at least one moveable member, and substantially adjacent thereto when in a non-deployed configuration, (ii) the movable member is at least one selected from (a) rotatable in a plane that is substantially parallel to the outward-facing surface of the underlying intermediate member and (b) outwardly displaceable, in a direction substantially perpendicular to the outward-facing surface of the intermediate member, such that a desired gap is formed therebetween; and (iii) the intermediate member is configured to operatively connect to a separate substrate.

16. The bumper system kit of claim 15, wherein the operative connection between the at least one moveable member and the intermediate member is at least one selected from shock-absorbing, and tiltable.

* * * * *